US007252475B2

(12) United States Patent
Tarelin et al.

(10) Patent No.: US 7,252,475 B2
(45) Date of Patent: Aug. 7, 2007

(54) ELECTROSTATIC METHOD AND DEVICE TO INCREASE POWER OUTPUT AND DECREASE EROSION IN STEAM TURBINES

(76) Inventors: Anatoly Oleksiovych Tarelin, Uberovych St., 50-6, Apt. 114, Kharkov-129 (UA) 310129; Volodymyr Petrovych Skliarov, Korolenko St. 4, Pivdenny-2, Kharkiv Oblast (UA) 312118; Oleh Weres, c/o Sonoma Research Company, 101 S. Coombs St., Suite L, Napa, CA (US) 94559

( * ) Notice: Subject to any disclaimer, the term of this patent is extended or adjusted under 35 U.S.C. 154(b) by 170 days.

(21) Appl. No.: 11/034,907

(22) Filed: Jan. 12, 2005

(65) Prior Publication Data

US 2005/0207880 A1 Sep. 22, 2005

Related U.S. Application Data

(60) Provisional application No. 60/535,905, filed on Jan. 12, 2004.

(51) Int. Cl.
*F01D 25/32* (2006.01)

(52) U.S. Cl. ..... 415/1; 415/169.2; 60/685

(58) Field of Classification Search ..... 415/169.1, 415/169.2, 1; 60/685
See application file for complete search history.

(56) References Cited

U.S. PATENT DOCUMENTS 3,859,005 A 1/1975 Huebner
5,735,125 A * 4/1998 Tarelin et al. ..... 60/685
5,992,152 A * 11/1999 Weres et al. ..... 60/685
6,672,825 B1 * 1/2004 Tarelin et al. ..... 415/1
6,698,205 B2 3/2004 Tarelin et al.

OTHER PUBLICATIONS

Dooley et al. "Studies of electrostatic charge effects relating to power output from steam turbines." PowerPlant Chemistry, v7, n2, Feb. 2005 at pp. 75-76.

Cite #3 was presented at a conference in Japan on Aug. 29, 2004 which predates the instant application, but postdates our PPA U.S. Appl. No. 60/535,905, benefit of which is claimed, filed Jan. 12, 2004.

* cited by examiner

*Primary Examiner*—Ninh H. Nguyen
(74) *Attorney, Agent, or Firm*—Oleh Weres

(57) ABSTRACT

The wet steam exiting a low pressure steam turbine does not rapidly attain thermodynamic equilibrium because insufficient condensation nuclei are present in the phase transition zone inside the turbine. Therefore, the steam is subcooled, decreasing the power generated by the turbine, and the liquid water carried by the steam consists of relatively coarse droplets which strike the surface of the turbine blades causing erosion. Corona electrodes installed inside the turbine before the saturation line create electrically charged particles which serve as condensation nuclei, decreasing subcooling, and producing a large number of fine droplets. Thereby, thermodynamic equilibrium is more closely approached, more power is generated, and smaller water droplets cause less erosion inside the turbine.

20 Claims, 2 Drawing Sheets

Figure 1:
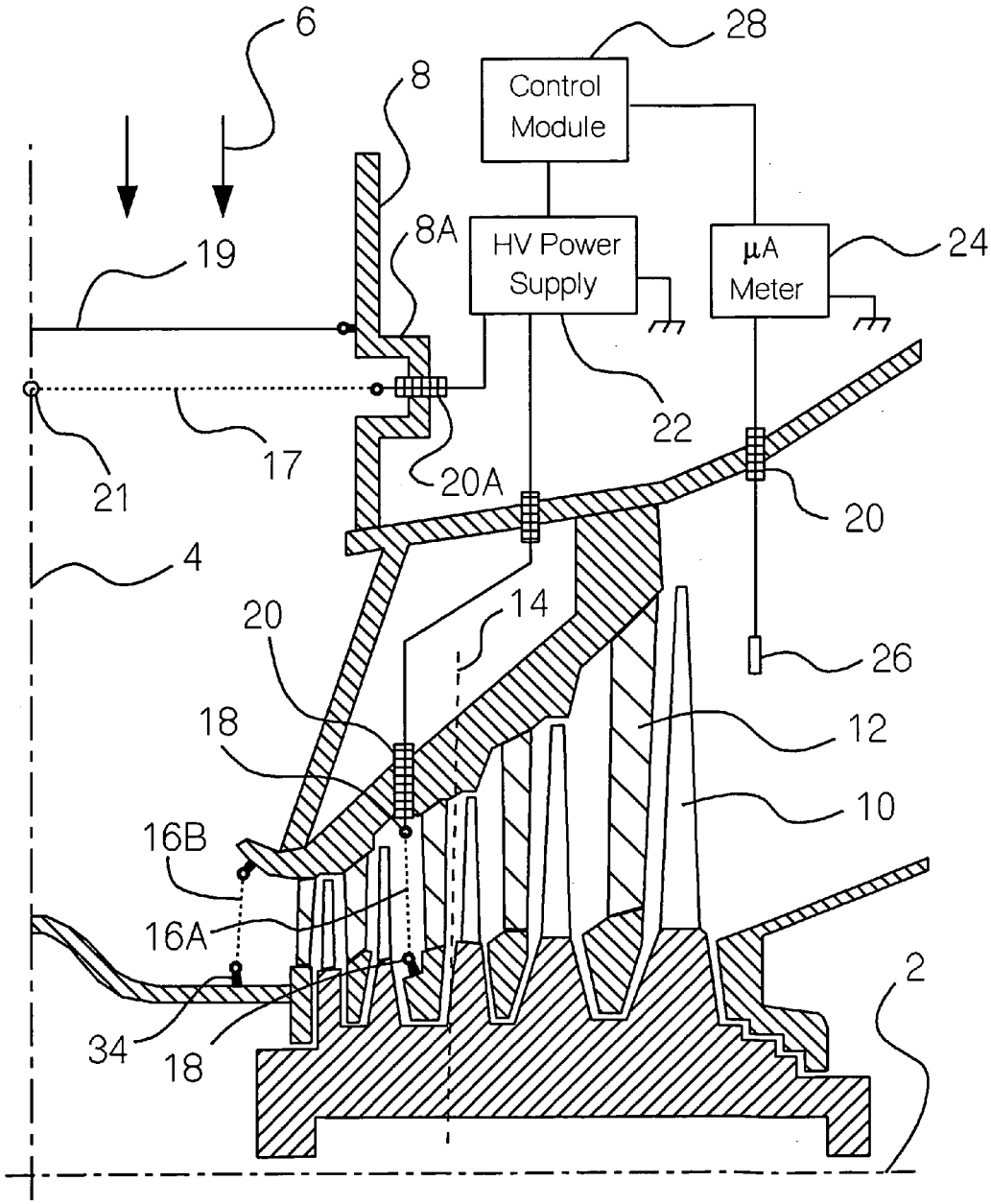

ELECTROSTATIC METHOD AND DEVICE TO INCREASE POWER OUTPUT AND DECREASE EROSION IN STEAM TURBINES

Priority is claimed based on U.S. Provisional Patent Application 60/535,905 which was filed 12 Jan. 2004.

FIELD OF INVENTION

This invention is related to energy conversion efficiency and reliability of steam turbines. A method and device are provided which decrease subcooling of steam in the low pressure part of the turbine and also decrease the number of large water droplets produced, whereby the energy conversion efficiency of the turbine is increased, and erosion of the turbine blades and diaphragms by impinging water droplets is decreased.

PRIOR ART

It is known in the art that the enthalpy of wet steam in the low pressure part of a turbine can be increased by heating the stationary blades or diaphragms with superheated steam that is provided through special channels inside the stationary blades ("The efficiency of the wet steam stages of a turbine with heated stationary blades." *Trudy Moskovskogo Energeticheskogo Instituta,* 663, pp. 48-56, 1993). Increasing the enthalpy of the steam in this way partly evaporates the film of condensate on the surface of the stationary blades, whereby the amount of moisture in the steam and especially the number of large water drops decreases, and erosion of the low pressure turbine blades is decreased. This method has two practical disadvantages: the steam passages must be provided in the design and construction of the turbine whereby complexity and cost of the turbine are increased, and superheated steam is consumed in a thermodynamically inefficient manner.

It is also known that addition of appropriate surface active chemical agents (surfactants) to the feed water decreases the surface tension of the condensate film that forms on the blades in the low pressure part of the turbine. Reduced surface tension allows smaller and more numerous droplets to be torn off the turbine blades, providing a greater number of nuclei for condensation of water vapor, whereby the degree of subcooling and erosive damage to the turbine blades are decreased (GDR Patent 207,116 issued 15 Feb. 1984). The primary drawback of this approach is the amount of surfactant that must be added to the feed water, typically in the range 100 ppb to 1,000 ppm. Because the surfactant decomposes in the high temperature part of the steam cycle, it must continually be replenished and the products of decomposition must be removed, whereby operating costs increase and water quality may be degraded. Also, the beneficial effect of adding surfactants is small.

Huebner, U.S. Pat. No. 3,859,005 proposed to apply an electric potential of 10 kilovolts to the stationary blades in the low pressure part of the turbine, and preferably also apply an electric potential of the same sign to the rotating blades, whereby Huebner asserted that smaller water drops would be torn off the stationary blades, and impingement of the charged water drops on to the rotating blades would decrease due to electrostatic repulsion. However, Huebner's method as described and illustrated in U.S. Pat. No. 3,859,005 would be inoperable because no counterelectrode internal to the turbine is provided in his design. Attaching one pole of a high voltage power supply to the steam turbine while attaching the other pole to some external ground would have no effect inside the turbine, because there would be no electric fields produced inside of the turbine. The magnitude of the electric potential that could be applied to the stationary blades relative to the rotating blades would be limited by the low resistance electrical connection that exists between the stationary parts of the turbine and the rotating parts by way of the turbine shaft bearings. Instead of creating a usefully large electric field inside the turbine, trying to impose a potential difference between the stationary and rotating parts of the turbine would more likely cause severe damage to the turbine shaft bearings by leakage of electric current through the bearing surfaces.

Even if it did work, Huebner's method would serve only to decrease drop size well within the phase transition zone, where a substantial amount of the liquid phase is already present; therefore, the desirable effect of decreased subcooling would be small. In fact, Huebner made no reference to decreased subcooling in his specification. The present invention is superior because it actually will create charged particles in the steam inside the LP turbine, and charged particles will be present at the saturation line and throughout the phase transition zone, whereby subcooling will be decreased and power output will be increased in addition to decreasing erosion. Also, Huebner did not mention corona discharge as a source of electrically charged particles inside the LP turbine.

The closest operable prior art is that provided by Tarelin et al. in U.S. Pat. No. 6,698,205 which is herein incorporated by reference. Tarelin provided a circle of sharp-pointed stainless steel pins mounted about the periphery of the diffuser and exposed to the high velocity steam flow out of the turbine. In one embodiment of Tarelin's invention, the pins are mounted on a circular collector which is isolated from electrical ground; that is, from the metallic structural members of the turbine itself. Connecting these pins to ground or, preferably, applying an electrical potential to them of sign opposite to the charge of water drops dispersed in the steam causes a substantial fraction of the the electric charge present in the steam to be removed. Decreasing the amount of electric charge present in the steam decreases the electrostatic force opposing steam flow out from the turbine, and also decreases the amount of turbulence produced when the charge in the steam eventually goes to ground further downstream. The net effect is an increase in the amount of electric power generated.

The present inventors have since performed additional experiments using the installation described in the preceding paragraph and discovered that removing charge from the steam downstream of the last stage of the turbine actually increases the amount of charge that is released to the steam in the first place. The charge released from the turbine creates a steady state distribution of space charge downstream of the turbine, and this space charge creates a powerful electric field at the trailing edges of the L-stage turbine blades which acts to decrease the release of charged water droplets; thus, the release of electric charge from the L-stage of the turbine is a self-limiting effect. Removing part of the space charge downstream of the turbine decreases the intensity of the electric field associated with the space charge, whereby the self-inhibitory effect is diminished and more charge is released to the steam. This increase in charge density immediately downstream of the turbine results in a larger concentration of nuclei for condensation in the same region, whereby subcooling of the steam is decreased and steam temperature increases by about 0.6K. This effect also contributes to the increased power output enabled by the invention provided by Tarelin et al. Of course, the beneficial effects of decreased subcooling in the steam flowing out of the turbine are in this case restricted to the last stage of the turbine and the exhaust hood. Also, this beneficial effect is entirely dependent upon the "natural" presence of electric charge in the steam, which in turn depends on the amount of moisture present in the steam and several subtle chemical variables; for example, the amount of ammonia or another volatile base present in the feed water, the surface composition of the low pressure turbine blades, and the presence or absence of silica deposits inside the low pressure part of the turbine. These chemical factors are discussed by Weres et al. in U.S. Pat. No. 5,992,152 which is herein incorporated by reference.

TERMS DEFINED

"C" is the abbreviation for Coulomb, the basic unit of electric charge

"Cable corona electrode" refers to a thin, flexible kind of corona electrode which needs to be installed under tension; for example, stainless steel cable, barbed wire or metallic tinsel "Charged particles" includes all charged species that would be produced near to a corona electrode operating in dry or slightly wet steam or another suitable working fluid, including free electrons, protons, various molecular ions, and clusters of molecules aggregated around smaller charged particles "Corona current" is the electric current that flows between a corona electrode and the steam flowing past it "Highly corona active electrode" is a corona electrode which will start to emit a corona discharge at a lower applied voltage than would a less corona active electrode, and which will emit a large corona current at a given applied voltage than would a less corona active electrode; typically, more highly active corona electrodes are festooned with sharp points, bristles, fine metallic wires, etc., which create locally intense electric fields when a voltage is applied, favoring corona discharge "High voltage" is shorthand for "voltage relative to ground large enough to produce a corona discharge when applied to a corona electrode." In the present context, the voltage required and used will range from a few kilovolts to about 60 kV, depending on steam density and the type of corona electrode employed.

"Inside the turbine" refers to a location between two adjacent rows of turbine blades inside the turbine "Linear brush" refers to an elongated, semirigid metallic member with brushlike bristles affixed along its length; such brushes are commercially available and commonly used to remove static electricity from a moving sheet of paper, etc.

"LP turbine" refers to a discrete low pressure turbine in a steam cycle power generating unit, or to the low pressure part of a compound turbine "Metallic tinsel" typically has a core made by twisting two or three wires together, and many metallic bristles sticking out from the wires, very much like the string & foil tinsel used to decorate a Christmas tree; metallic tinsel is commercially available and commonly used to remove static electricity from a moving sheet of paper, etc.

"Phase transition zone" refers to the region within a turbine, bounded on the upstream side by the saturation line, in which water droplets are nucleated and grow "Row of turbine blades" refers to a row of discrete turbine blades, a turbine wheel or a diaphragm in the same generalized manner as the present usage of "turbine blades" defined below "Semirigid corona electrode" refers to a corona electrode which is thin but fairly rigid, and may be installed by firmly fastening both ends but not necessarily with significant tension applied; for example, an extruded square rod or "star" rod (16X in FIG. 2), a serrated strip of metal, a linear metallic brush, etc.

"Saturation line" refers to the location within the LP turbine at which the steam reaches thermodynamic saturation and the formation of water droplets becomes possible in the thermodynamic sense "Steam" as used in the claims includes dry steam and wet steam "Turbine blades" is used herein as a shorthand term that includes turbine buckets, stationary blades, and nozzles and diaphragms as well as rotating turbine blades; thus, a location "between adjacent rows of turbine blades" would include, for example, a location between rotating turbine blades on one side, and a diaphragm on the other. A more precise equivalent would be "turbine working elements selected from the class consisting of rotating turbine blades, stationary turbine blades, buckets, nozzles or diaphragms."

"Upstream," "downstream," "before," "after," and "through" as used herein are all defined in relation to the path and direction of steam flow through the turbine, and more specifically to the direction of steam flow through the several rows of turbine blades (diaphragms, etc.) inside the turbine.

"Working fluid" as used in the claims includes steam as well as other working fluids sometimes used to drive turbines; for example, ammonia, a mixture of steam and ammonia, butane, a volatile fluorocarbon, etc.

Additional terms of art relevant to turbines, corona discharge apparatus and this invention are defined by Tarelin et al. in U.S. Pat. No. 5,735,125 which is herein incorporated by reference.

SUMMARY OF THE INVENTION

While we believe the explanations given herein to be correct, we do not wish to be bound by them.

Because an inadequate number of condensation nuclei are available in the phase transition zone, phase equilibrium is not attained, and the steam flowing and expanding within the last stages of the turbine is subcooled. A substantial amount of moisture condenses directly on the surfaces of the turbine blades, and a relatively small number of relatively large water drops are produced when the resulting condensate film is torn from the surface of the blades. These coarse drops provide few nuclei for condensation, and impinge upon the following turbine blades, decreasing the energy conversion efficiency of the turbine and damaging the blades by erosion.

The essence of the present invention lies in adding electric charge to the steam before it reaches the saturation line in a low pressure steam turbine in order to provide abundant condensation nuclei within the phase transition zone. The source of charge is an array of corona electrodes preferably installed inside the LP turbine just before the saturation line, or at some point upstream of the LP turbine blades. Injecting electric charge into the steam at any of these locations will provide some concentration of charged particles within the phase transition zone. The large concentration of nuclei thus provided within the phase transition zone greatly enhances condensation inside the turbine, whereby subcooling is decreased and the average size of water droplets present in the steam becomes much smaller. These changes increase power output and decrease erosive damage to the blades, nozzles and diaphragms in the low pressure part of the turbine. Further benefit may be obtained if the electric charge present in the steam flowing out of the turbine is removed using the "spikes" described by Tarelin et al. in U.S. Pat. No. 6,698,205; that is, if the two inventions are installed and used together.

Throughout this specification, numerous references are made to a "low pressure turbine" because it is expected that this invention will find its most immediate and widest application in the low pressure turbines of steam cycle power plants. While this invention is expected to find its principle application in electric power generating stations equipped with steam turbines and surface condensers, it may also be used in connection with steam turbines used in other applications; for example, marine propulsion systems. Similarly, the invention is applicable to a power generating unit equipped with a contact condenser, or no condenser at all. The invention may be beneficially applied to any steam turbine wherein steam crosses the saturation line.

Finally, this invention can be used in connection with turbines that use a working fluid other than steam; for example, ammonia, ammonia-water or a volatile fluorocarbon. The only essential requirement is that a saturation line be located within the turbine, whereby the working fluid flowing out of the turbine would contain some amount of dispersed liquid phase if it approached thermodynamic equilibrium. In any such turbine—regardless of working fluid—introducing electrically charged particles into the phase transition zone will tend to increase power output and decrease erosion by liquid droplets.

DRAWING FIGURES

FIG. 1 depicts part of a low pressure turbine with the invention implemented. Only the upper portion of one half of a double flow turbine is depicted. The axis of the turbine is labeled 2, and the midplane is labeled 4.

Figure 2:
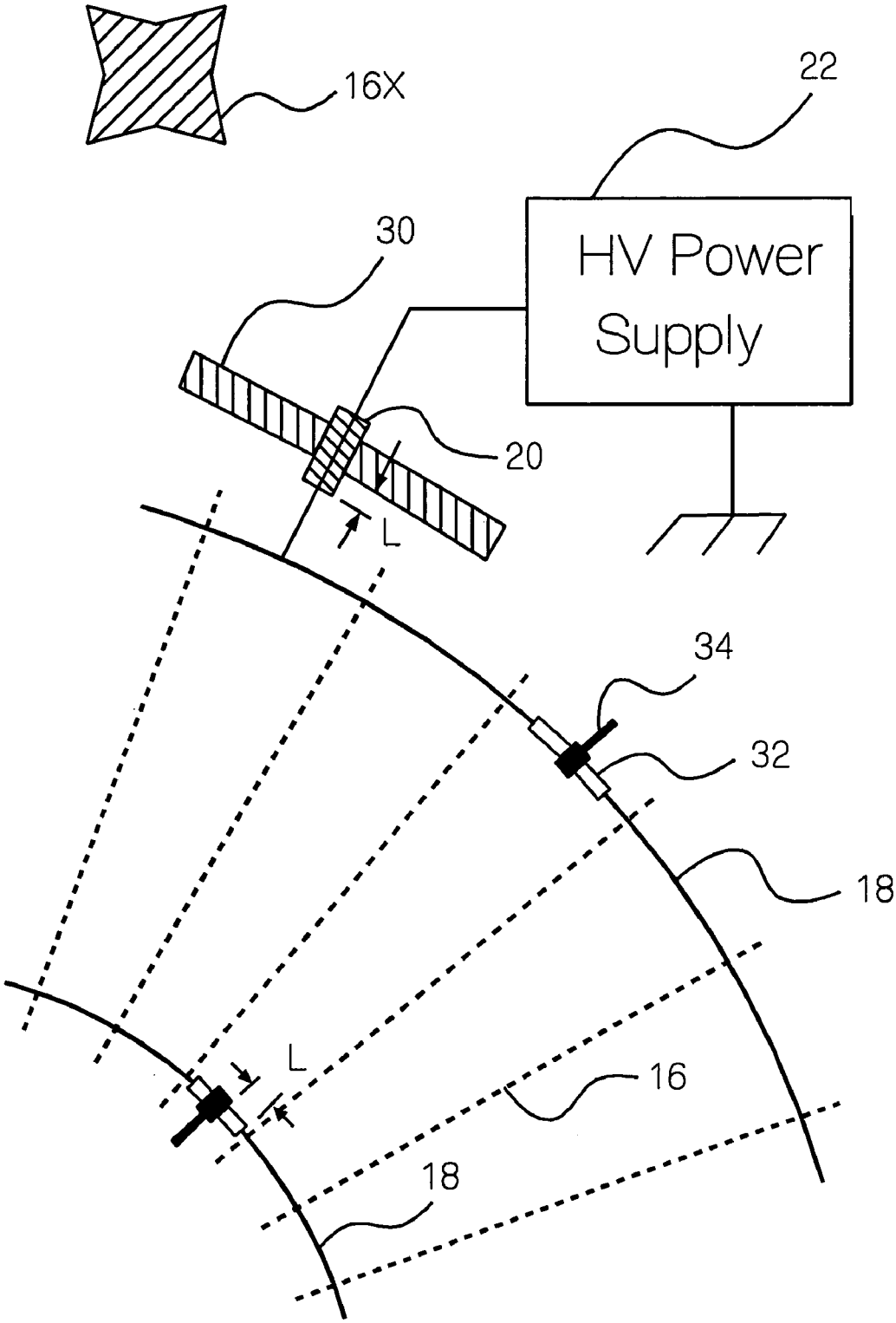

FIG. 2 illustrates the preferred construction of the array of corona electrodes 16A or 16B in FIG. 1.

The following details are labeled in the figures:

2 Axis of the LP turbine rotor
4 Midplane of double flow LP turbine
6 Steam entering LP turbine
8 Wall of the main steam pipe supplying the LP turbine
8A Indentation in wall of main steam pipe 8 where feed-through insulator 20A or a supporting insulator is installed
10 Rotating turbine blades or buckets
12 Stationary blades, nozzles or diaphragms
14 Saturation line
16A Preferred location for a circular array of semirigid corona electrodes, best suited for installation in a new turbine or in a rebuilt turbine
16B Circular array of semirigid corona electrodes located proximately upstream of the LP turbine blades which could more easily be installed in an existing turbine
16X Common "star" cross-section of a semirigid corona electrode, about 3/16 inch=4.8 mm wide
17 Cable corona electrodes or semirigid corona electrodes installed inside the steam pipe supplying an existing LP turbine
18 Collector rings which physically support semirigid corona electrodes 16A and 16B and connect them electrically to high voltage power supply 22 and are conveniently made by bending stainless steel rod or heavy walled stainless steel tubing into circular arcs; each collector ring may consist of two or more arcuate sections electrically interconnected
19 Grounded counterelectrodes preferably comprising stainless steel rod or cable disposed upstream of and parallel with corona electrodes 17
20,20A Feed-through insulators with insulating body length preferably not less than about 15 mm.
21 Point where several corona electrodes 17 cross and may conveniently be electrically interconnected using a clamp, a tie wire or another suitable means
22 Regulated high voltage DC power supply with one pole connected to the array of corona electrodes and the other pole electrically connected to ground; that is, the casing of the turbine
24 Current meter to measure 0-1,000 microamperes
26 Charge probe of the general type described in U.S. Pat. No. 5,992,152
28 Control module which regulates the current output of the high voltage power supply to maintain current flowing through the charge probe to ground within a predetermined range of values beneficial to the operation of the method
30 Turbine case
32 Insulating sleeve made of flexible plastic tubing, preferably silicone rubber or perfluoroalkoxy resin (PFA) or another fluorocarbon resin
34 Metal mounting brackets that support the collector rings
L Minimum insulating length should be not less than about 15 mm Three possible locations for the corona electrodes are depicted in FIG. 1: location 16A, inside the LP turbine between adjacent rows of turbine blades just before saturation line 14; location 16B, just before the steam enters the LP turbine blades; and location 17, in the steam pipe or duct which supplies steam to the LP turbine. These locations represent alternative implementations of the invention; a specific installation would in most cases require electrodes in only one of these three locations.

OPERATION OF THE INVENTION

High voltage power supply 22 applies voltage to the corona electrodes (16A, 16B or 17) sufficient to produce a corona discharge at the surface of the corona electrodes, whereby free electrons and ions are produced and dispersed in the steam. The flowing steam carries these charged particles with it as it crosses saturation line 14, and water molecules bind to them, creating nuclei for condensation. As continued expansion further decreases the temperature, condensation continues and these nuclei grow, creating very many small droplets If the number of ions injected and number of nuclei created are sufficiently large, rapid condensation takes place, and the temperatures does not fall below significantly below the saturation value as the steam expands. Therefore, expansion takes place practically under equilibrium conditions, maximizing the amount of useful work extracted from the steam and increasing power output. It is known that subcooling of the steam can decrease the power produced by the LP turbine by as much as 2.5%; therefore, minimizing subcooling can increase the power produced by the LP turbine by a like amount.

Because the injected ions create very many nuclei for condensation, many small water droplets are formed which move together with the steam and mostly do not impinge on the turbine blades and other solid surfaces inside the turbine.

Because the solid surfaces do not accumulate much moisture by condensation or impingement, the formation of large drops by tearing of the liquid film off the solid surfaces is minimized. Therefore, erosion of metal surfaces by impingement of water droplets—large as well as small—is greatly reduced. Efficiency losses related to moisture are reduced as well, further increasing power output.

In order to prevent erosion of metal surfaces inside the turbine, the diameter of water droplets in the steam should not exceed 1 μm (G. A. Filippov, O. A. Povarov, and V. V. Priakhin. *Investigation and design of wet steam turbines*. Energia Publishers, Moscow, 1973, p. 232). Ten percent equilibrium moisture content corresponds to $1.91\times10^{14}$ droplets of this size per kilogram of steam. If each droplet is nucleated by a single ion, the amount of electric charge required will be $3.06\times10^{-5}$ C $kg^{-1}$ of steam. A typical turbine with 300 kg $s^{-1}$ steam flow would require a corona current of just 9.2 milliamperes to provide this density of charge, assuming that 100% of the ions created nucleate water droplets.

As a practical matter, a somewhat larger corona current should be provided, because a fraction of the ions produced will impinge grounded solid surfaces inside the turbine instead of nucleating water droplets. The excess current required will depend on the location of the corona electrodes. Corona electrodes 16A located near to saturation line 14 will require modest excess current, while corona electrodes 16B or 17 installed upstream of the LP turbine blades will require a much large excess of corona current, because much charge will be lost in the superheated zone before the electrified steam reaches saturation line 14.

Depending on the location of the electrodes and the equilibrium moisture content of the steam flowing out of the turbine, somewhere in the range of 10 to 1,000 microcoulombs of charge per kilogram of steam will need to be injected to provide a beneficial number of electrically charged particles in the steam within the phase transition zone.

The breakdown electric field strength of dry steam is approximately proportional to the density of the steam which increases with pressure. Therefore, a greater voltage must be applied to produce a corona discharge at electrodes 16B or 17 upstream of the LP turbine blades than would be required at location 16A inside the LP turbine, where the pressure and density of the steam are much smaller.

Laboratory experiments designed to simulate these processes have confirmed that injecting charge into expanding steam does, in fact, decrease subcooling, and also that negative charge has a more beneficial effect than positive charge. The use of negative charge is preferred for another reason as well. Turbine blades are usually made of alloy steels or titanium alloys. These alloys resist corrosion by formation of a passivating metal oxide film that protects the metal. If negatively charged water droplets strike the surface of the turbine blades, anodic polarization of the surface of the blade will result, enhancing the passivation effect and causing no harm to the metal. However, if positively charged droplets were to strike the surface, cathodic polarization would result, possibly causing hydrogen to be produced and diffuse into the metal, whereby the possibility of hydriding and metal embrittlement would arise.

The beneficial effect will vary with the amount of charge present in the steam at the saturation line, which, in turn, will depend on voltage applied to the corona electrodes, velocity of steam flow, unit load, etc. The amount of charge added to the steam and therefore the amount of charge present at the saturation line can be controlled by varying the voltage applied to the corona electrodes, and an automatic control system can be provided as illustrated in FIG. 1.

The sign and amount of charge present in the steam flowing out of the LP turbine will be a related to the amount of charge present at saturation line 14. Therefore, the amount of charge present at the saturation line can be maintained within a range of values beneficial to the operation of the method by maintaining the amount of charge in the steam exiting the turbine within a corresponding range. Weres et al. provided a method and apparatus to measure charge in steam in U.S. Pat. No. 5,992,152. A metallic probe isolated from electrical ground is exposed to the steam flow, and the electric charge collected by the probe is conducted to ground through a sensitive current meter, most conveniently one configured to measure current in the range of 0-1,000 microamperes. The current to ground is approximately proportional to the density of electric charge present in the steam. The output of the microammeter (which need not be more complicated than a resistor which converts the current from the probe to a voltage signal) is connected to a control module, which adjusts the output voltage and/or current of the HV power supply to keep the current from the probe within a predetermined range of values beneficial to the operation of the method.

The range of values of current from charge probe 26 most beneficial to operation of the method is determined during initial testing of the installation, by systematically varying the voltage applied to the corona electrodes while monitoring the energy conversion efficiency of the turbine and the current from charge probe 26.

A control system of this description or its functional equivalent is recommended in connection with each of the three specific embodiments of the invention described in the Examples that follow.

EXAMPLE 1

In the preferred embodiment of the invention, corona electrodes are installed at location 16A within the LP turbine and between adjacent rows of turbine blades just before the saturation line. Locating the corona electrodes at 16A allows the corona discharge to operate at a relatively low voltage because the steam pressure at this point is on the order of 0.5 bar. Also, a large fraction of the charge injected will actually reach the phase transition zone instead of going through ground through the turbine blades as the electrified steam flows past them. Assuming that about 50% of the current is lost to ground, a 200 watt DC power supply able to provide 20 mA at 10,000 V would suffice the power the corona electrodes 16A in a turbine with 300 kg $s^{-1}$ steam flow.

Semirigid corona electrodes are preferably used at location 16A between the LP turbine blades to limit deformation under the pressure of the steam flow, and minimize the risk of breaking an electrode. Some types of semirigid electrodes used in electrostatic precipitators are suitable, provided they do not block steam flow excessively; these semirigid electrodes are designed to work at atmospheric pressure, and will work even better at 0.5 bar. Semirigid electrodes made of stainless steel with "star" cross-section about 4.8 mm wide (16X in FIG. 2) and slightly twisted along the axis to make the ridges gentle spirals are a good choice.

The preferred assembly is illustrated in FIG. 2. Semirigid electrodes 16 are spot-welded to collector rings 18, which are made by bending heavy-walled stainless steel tubing into circular arcs. Each collector ring 18 is firmly supported by several metal brackets 34 disposed around the circumference of the ring. Isolation from each mounting bracket 34 and electrical ground is provided by an insulating sleeve 32, which is preferably a length of tubing made of silicone rubber, perfluoroalkoxy resin (PFA), or another fluorocarbon resin with a wall thick enough to reliably isolate the voltage applied to corona electrodes 16. Collector rings 18 and corona electrodes 16 are connected to high voltage power supply 22 by way of one or more pass-through insulators 20 installed in the wall of turbine case 30.

Rigid corona electrodes in the form of sharp spikes fastened to one or more collector rings could also serve in this location.

At 0.5 bar, a vapor gap of about 8 mm will just suffice to prevent breakdown and electrical discharge with 10 kV voltage applied across the gap. In order to provide a margin of safety, the energized corona electrodes should be no closer than about 15 mm to the turbine blades, and the insulating body length L on insulating sleeves 32 and feed-through insulators 20 should be at least 15 mm as well. In order to allow a 15 mm gap on either side of the semirigid electrode plus a few millimeters for the electrode itself, the distance separating the rows of turbine blades adjacent to electrodes 16A should be about 40 mm.

The number of semirigid electrodes 16A will be a compromise between the desire to inject charge uniformly across the flow area of the LP turbine, and the need to limit the degree of interference with the steam flow. About 72 semirigid electrodes 16A radially disposed is a good compromise; that is, disposed at intervals of 5 degrees of arc. In an LP turbine of typical size, this number of electrodes will provide lateral spacing between the electrodes comparable to the 40 mm gap between the adjacent rows of turbine blades, and will block less 10% of the area available for steam flow.

Because corona electrodes 16A require a 40 mm gap between the two adjacent rows of turbine blades, this embodiment of the invention is best suited to a new turbine or a turbine that is being extensively rebuilt.

EXAMPLE 2

An existing LP turbine can most easily be provided with this invention by installing corona electrodes 17 inside steam pipe 8 just before it connects to the steam chest of the LP turbine. This installation can be realized with no modifications to the turbine itself. Preferably, three corona electrodes 17 are installed in a coplanar disposition, spaced at 120° apart and electrically interconnected at crossing point 21. Corona electrodes 17 are suspended between insulators 20A which are preferably mounted inside recesses 8A in the wall of steam pipe 8 to shield them from direct impact of the steam flow and minimize drag. At least one of insulators 20A must be a feed-through insulator, allowing an electrical connection of corona electrodes 17 to high voltage power supply 22.

Optionally, grounded counterelectrodes 19 are installed upstream of corona electrodes 17 and in parallel with them to even out the electric field intensity and promote an even distribution of corona discharge current along the length of each corona electrode 17. No corona discharge activity is needed or wanted at the surface of grounded counterelectrodes 19. Therefore, smooth stainless steel rods or cables can be used for this purpose.

Corona electrodes 17 inside steam supply pipe 8 will be immersed in superheated steam at 3 to 12 bar pressure and moving with a velocity that is small in relation to the flow velocity inside the turbine near to the saturation line. This means that the drag on corona electrodes 17 and interference with steam flow will be small. However, the breakdown electric field strength of the steam at corona electrodes 17 is large in proportion to the density of steam at that location; therefore, a correspondingly greater electric field strength is needed to create a corona discharge at the surface of corona electrodes 17 as compared to corona electrodes 16A inside the LP turbine. Preferably, about 60 kV should be applied to corona electrodes 17; this value represents about the maximum design voltage consistent with easy design and installation, and safe operation. Also, corona electrodes 17 should be highly corona active, with many sharp or angular protrusions. Because steam flow velocity at this point is relatively small and the steam is completely dry and free of solid particles, a wide range of electrode structures may serve, including electrodes which might not be suitable for use in an electrostatic precipitator. In this location, highly corona active electrodes are needed above all, while mechanical strength and rigidity can be compromised to some degree. Either a cable corona electrode stretched between two insulators (for example, metallic tinsel or a barbed wire electrode) or a semirigid electrode supported at either end by an insulator (for example, a linear metallic brush or a serrated metallic strip) may be used. Other suitable electrode structures for this location will be known to persons skilled in the arts of corona discharge and control of static electricity.

Charge added to the steam by corona electrodes 17 will be carried by the steam through the steam chest of the LP turbine and through several rows of turbine blades before it reaches saturation line 14, and losses to ground through the various metallic surfaces encountered will be relatively large. Therefore, a considerable excess of charge must be injected by corona electrodes 17. For this reason, and for the reasons discussed above, a high voltage power supply able to provide 200 mA or more at 60 kV is recommended for this implementation of the invention with steam flow of 300 kg/s.

EXAMPLE 3

Corona electrodes can be installed at another location before the LP turbine blades, for example semirigid corona electrodes 16B installed just before the steam enters the blades of the LP turbine. The construction illustrated in FIG. 2 is suitable for this location as well, but high activity semirigid electrodes must be used because of the high steam density; for example, a linear metallic brush, or a serrated strip. To provide an even distribution of charge, the distance between the midpoints of adjacent electrodes should be no greater than the distance from the electrodes to the first row of turbine blades or the first diaphragm encountered by the steam. Thirty-six semirigid electrodes 16 attached to two collector rings 18 would be appropriate for the location depicted in FIG. 2. The specification for high voltage power supply 22 needed to power corona electrodes 16B would be the same as needed to power corona electrodes 17.

CONCLUSIONS, RAMIFICATIONS AND SCOPE

The invention provided herein allows the power output of a generating unit to be increased at low cost, while decreasing damage by erosion by impingement of water droplets within the low pressure turbine stages. The invention is especially beneficial in that the region of decreased subcooling is extended into the turbine itself, whereby subcooling is decreased in the steam as it flows through the last stages of the turbine. Unlike the related earlier inventions by the present inventors and their colleagues cited herein, the present invention does not depend on the amount of electric charge "naturally" present in the steam, whereby operation of the invention is less affected by the amount of moisture in the steam, and is hardly affected at all by the subtle chemical effects discussed in U.S. Pat. No. 5,992,152.

While our above description contains many specificities, these should not be construed as limitations on the scope of the invention, but rather as an exemplification of preferred embodiments thereof. Accordingly, the scope of the invention should be determined not by the embodiments illustrated, but by the appended claims and their legal equivalents. A particular embodiment of this invention will naturally be adapted to a particular steam turbine design, of which there are many, and to its operating parameters (power output, inlet pressure, etc.).

While the injection of negative charge is preferred, positive charge might also serve with turbine blades made of certain alloys, or if the charge density is too small to be of concern in regard to possible corrosion mechanisms.

The location, physical design, and number of corona electrodes can be varied widely within the scope of the invention claimed. For example, another location before the steam turbine can be selected, as between locations 17 and 16B depicted in FIG. 2. While the preferred location of corona electrodes 16A is just upstream of saturation line 14, corona electrodes can also be located at the saturation line or actually within the phase transition zone downstream of the saturation line.

Stainless steel is recommended as the material of construction for the corona electrodes because it has good corrosion resistance for this service and is unexpensive, but other suitable alloys could be substituted. Likewise, various dielectric resins, ceramics, etc., can be used to construct the required insulators, the dimensions, detailed design, number and locations of which will be specified in reference to the needs of a particular installation.

The design, number, material of construction and location of counterelectrodes may be varied; for example, if corona electrodes 16B are located at some distance from the LP turbine blades, counterelectrodes analogous to counterelectrodes 19 should be installed near to them and just upstream. Grounded counterelectrodes are preferred because they are easiest to provide and totally reliable. However, counterelectrodes held at some value of potential different from ground may provide slightly better performance and might therefore be preferred in some applications. In this case, connection of the nongrounded counterelectrodes to an external power supply would probably be required.

The specifications of the high voltage power supply may be varied as appropriate to a given generating unit.

While a corona discharge at metallic corona electrodes powered by an external high voltage power supply is the preferred way to provide charged particles in the phase transition zone, other methods might serve; for example, injecting an electron beam into the turbine through a suitable "window," or introducing radio frequency or microwave radiation to create a corona discharge at corona electrodes not connected to an external power supply.

The invention claimed is:

1. A method to increase the power output of a turbine having rows of turbine blades, working fluid flowing through said turbine, a phase transition zone, and a saturation line, wherein said saturation line and at least part of said phase transition zone are located upstream of at least one row of said turbine blades, which method comprises providing charged particles in said part of said phase transition zone that is located upstream of at least one row of said turbine blades, whereby said charged particles serve as condensation nuclei, a very large number of small droplets are nucleated, subcooling of the working fluid is decreased, more power is generated, and erosion of turbine blades by coarse droplets is decreased.

2. The method of claim 1, wherein said charged particles are provided by a corona discharge characterized by a value of corona current.

3. The method of claim 2, wherein said value of corona current suffices to introduce 10 to 1,000 microcoulombs of electric charge per kilogram of working fluid at the location of said corona discharge.

4. The method of claim 2, wherein said corona discharge is created by applying a voltage to corona electrodes.

5. The method of claim 4, wherein said working fluid is steam.

6. The method of claim 5, wherein the sign of the charge of said charged particles is negative.

7. The method of claim 5, wherein said corona electrodes are located upstream of said phase transition zone.

8. The method of claim 7, wherein said corona electrodes are located between adjacent said rows of turbine blades near to said saturation line.

9. The method of claim 7, wherein said corona electrodes are located upstream of said rows of turbine blades.

10. The method of claim 4, wherein said value of corona current is actively regulated to maintain the density of electric charge in said working fluid flowing out of said turbine within a predetermined range of values beneficial to the operation of the method.

11. A turbine having a working fluid flowing through said turbine, an electrical ground, rows of turbine blades, and a phase transition zone, wherein the improvement comprises further providing one or more corona electrodes isolated from said electrical ground and located upstream of at least one row of said turbine blades.

12. The turbine of claim 11 further provided With a power supply electrically connected to said corona electrodes.

13. The turbine of claim 12 wherein said working fluid is steam.

14. The turbine of claim 13 wherein said corona electrodes are located upstream of said rows of turbine blades.

15. The turbine of claim 14 wherein said corona electrodes are cable corona electrodes.

16. The turbine of claim 14 further provided with counterelectrodes disposed near to said corona electrodes, whereby the electric field surrounding said corona electrodes is rendered more uniform, and a more uniform corona discharge is produced.

17. The turbine of claim 13 wherein said corona electrodes are located between adjacent said rows of turbine blades.

18. The turbine of claim 17 wherein said corona electrodes are located upstream of said phase transition zone.

19. The turbine of claim 17 wherein said corona electrodes are affixed to and physically supported by one or more collector rings.

20. The turbine of claim 13, further provided with a regulating means to maintain the value of electric charge density in said working fluid as it flows out of said turbine within a predetermined range of values.

* * * * *